United States Patent [19]

Kulisch

[11] 4,040,415

[45] Aug. 9, 1977

[54] AIR BUBBLING MASSAGING APPARATUS

[76] Inventor: Ruth Kulisch, Schwalbenstrasse 5, D-2902 Rastede, Germany

[21] Appl. No.: 642,381

[22] Filed: Dec. 19, 1975

[30] Foreign Application Priority Data

Dec. 24, 1974 Germany ..... 2461475

[51] Int. Cl.[2] ..... A61H 9/00

[52] U.S. Cl. ..... 128/66

[58] Field of Search ..... 128/65, 66; 4/178, 180; 15/50, 327

[56] References Cited

U.S. PATENT DOCUMENTS

| | | | |
|---|---|---|---|
| 3,138,153 | 6/1964 | Osborn et al. | 128/66 |
| 3,184,775 | 5/1965 | Downey et al. | 15/327 R |
| 3,481,328 | 12/1969 | Powell | 4/180 X |
| 3,731,334 | 5/1973 | Carbonell | 15/50 R |
| 3,809,073 | 5/1974 | Baumann | 128/66 |

*Primary Examiner*—Lawrence W. Trapp

[57] ABSTRACT

Hot air blowing means is connected by a hose to a porous gridiron immersed in the bath. The hot air blowing means are contained in a first housing, adapted to be located adjacent the bath to be manipulable by the bather and including means for regulating the speed and duration of the operation of the hot air blowing means. A power pack for driving the hot air blowing means comprising at least a transformer is contained in a second housing independent of the first housing and separably locatable remote from the bather. The transformer has an input connected to a source of line current and a low voltage output no greater than 24 volts. The heating and blowing means are operable by the low voltage and are connected by an elongated low voltage cable to the transformer.

9 Claims, 3 Drawing Figures

AIR BUBBLING MASSAGING APPARATUS

BACKGROUND OF THE INVENTION

Figure 1:
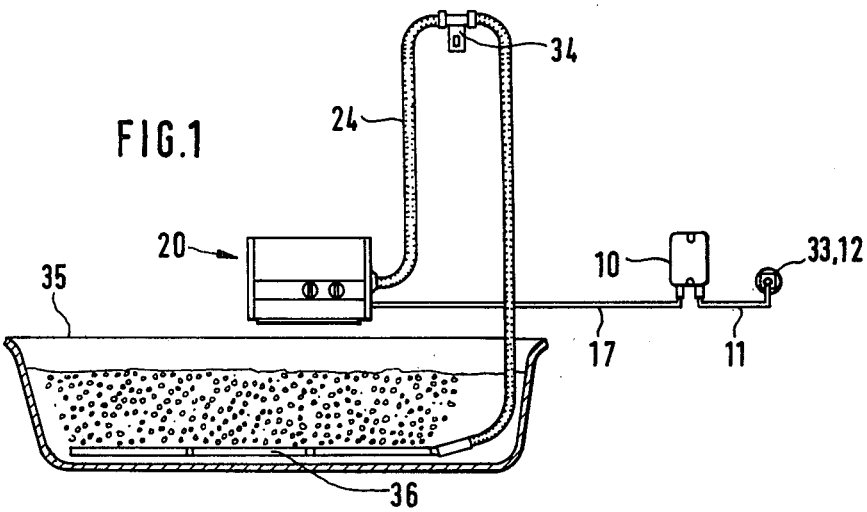

The present invention relates to air bubbling massaging apparatus for baths and the like.

An air bubbling massage device is shown in German patent publication No. DT-AS2,229,973. In devices of this type a single housing is provided containing a blower and a heater which are connected by an elongated air hose to a porous gridiron or air screen which is adapted to be immersed within the bath itself. The blower and heater are controlled by adjustable speed switches and timing devices, mounted on the exterior of the housing, so as to be manipulatable by the bather. The blower and heater are high voltage electrical units and are directly connected over a supply cable to a source of current such as a household line supply of AC current. To obtain a degree of safety, in this apparatus, the manipulatable control elements are covered by a lid, the movement of which controls and acts in combination with a switch located in the power line. When the lid is opened, the power supply is disconnected and the operation of the device is arrested. Thus, should the bather desire to adjust the controls during the time he is in the bath, he would first have to lift the cover, and presumably disconnect the apparatus from the power source.

Notwithstanding the aforementioned safety feature, the known apparatus such as that disclosed in the aforementioned German publication, is not at all optimal for its intended purpose. Since the power supply cable extends directly from the housing to the source of power, it is still possible for the bather to inadvertently come in contact with the relatively dangerous high voltage supply. In order to avoid this, the housing must therefore be placed out of the range of the bath tub so as to be completely outside the reach of the bather. Furthermore, when the blower and heater elements are driven by an alternating current source, the housing must be securely installed on the wall of the bathroom outside the range of the bathtub. The use of the apparatus even under these conditions is not possible since there remains the danger that if the housing containing the components is not properly fastened to the wall it may still fall into the bathtub.

The foregoing dangers may lead to the death of the bather. The application of other safety precautions to the known apparatus are of no help. Mounting the housing containing the heater and blower elements securely on the wall outside of the range of the bathtub has certain drawbacks with regard to the convenience of use and must be taken into account when considering the merchant-ability of the device. If, for example, the bather wishes, during the massage to adjust the pressure and/or temperature of the air or change the timed period for the operation of the device, then the bather must leave the bath and while wet and nude walk to the control apparatus. This mode of operation is not at all pleasant or convenient.

It is the object of the present invention to provide an air bubbling massage apparatus which overcomes the defects of the prior art and in which the apparatus may be controled or manipulated without any danger to the user, even when he is in the bath and which apparatus may be installed freely within the area of the bathtub and within easy reach of the bather while in the tub.

SUMMARY OF THE INVENTION

In accordance with the present invention the foregoing objects are obtained by providing a first housing in which the blower and heater elements, which may be in the form a water spray gun, are contained, and a separate and independent power pack contained in a second housing. The power pack includes a low voltage transformer which is connected by means of a line cord to a conventional source of power such as a household source of AC current, and that the low voltage is delivered from the power pack through a connecting cable to the housing containing the blower and heater components. In this manner, the housing containing the operating components and their adjustable control knobs and mechanisms, can be placed within the area of the bathtub, and within full reach of the bather. Since only a low voltage enters into this particular housing, the user is not placed in any dnager, even if the user were to inadvertently touch the low voltage cable or even if the housing would fall into the bathtub. It is furthermore not necessary, from a safety point of view, to require that the housing containing the operating elements, be securely installed and this particular housing may be left to be movable or transportable as desired by the user. It is sufficient or necessary only to install the smaller power pack housing, containing the supply transformer out of the reach or range of the bather. In addition to the ease by which the apparatus according to the present invention can be used it is possible to transport the apparatus, from place to place, that is from bathroom to bathroom so that a single unit may be employed to achieve air bubbling message in different tubs.

In the embodiment of the present invention, the housing containing the operative elements such as the blower and heater, is provided with a carrying handle by which its transport is easily obtained. In addition the housing is provided with a flat surface so that it can be stood on a table, shelf or the like, and also with a flat rear wall containing means in which it may be securely fastened or hung to the bathroom wall if desired. Thus, the housing can be placed either near the bath or it can be secured on the wall adjacent to the bath. In the first case, the apparatus can depending upon the desire or necessity of the user, be easily moved and placed in different areas or different rooms. It is therefore preferable that the low voltage connecting cable between the housing containing the blower and heater elements, and the power pack housing, is removably received by plug and socket means in either or both of the two housing.

Preferably the power pack housing is small and can be securely fastened to the wall and left fastened on the wall outside of the area of the bath. In this manner, the power pack can be retained as a more or less permanent fixture in the bathroom permitting its connection to the housing containing operative elements, as desired. Preferably the power pack supply housing is formed of two parts, in which the power pack elements can be easily enclosed. The housing may be provided with anchoring means, such as a screw or bolt member which serve simultaneously to secure the two halves of the housing together while securing the same to the wall. Both the power jack housing, as well as the housing containing the operative components such as the blower, heater and the spray gun or nozzle apparatus are provided with seal means and sealed connections, which will effectively render them water and vapor proof.

Adjustment of the time operation of the apparatus can be obtained by mechanical means, such as a spring driven timer. This type of timer does not require any source of current and its control knob can therefore be placed on the face of the housing. Similarly, the control means for varying the speed of the fan can also be arranged in the same manner.

In spite of the small drive power supply delivered to the housing, a relatively powerful blower can be located therein. In a further embodiment of the present invention, the power pack is supplied with a rectifier and filter condenser so that a direct current power source can be supplied to the operating housing, in which a direct current hot air blower can be located. Such a direct current blower can be continually regulated and varied in a rather simple manner. The speed of such a blower, can be regulated for example, by an adjustable thyristor diode switching network or circuit, the control knob of which can also be placed on the exterior of the housing.

Full details of the present invention are set forth in the following description and are illustrated in the accompanying drawings.

BRIEF DECRIPTION OF THE DRAWINGS

Figure 2:
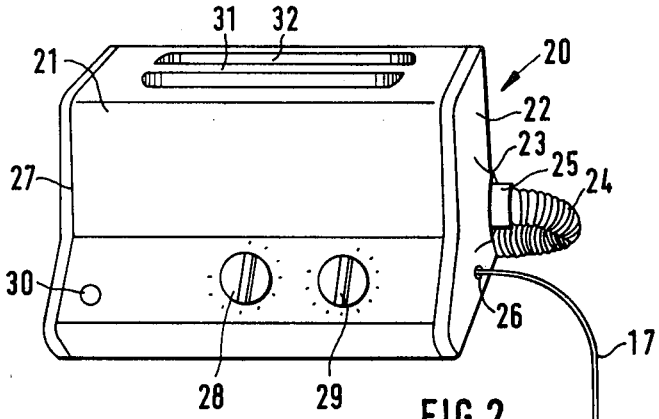
Figure 3:
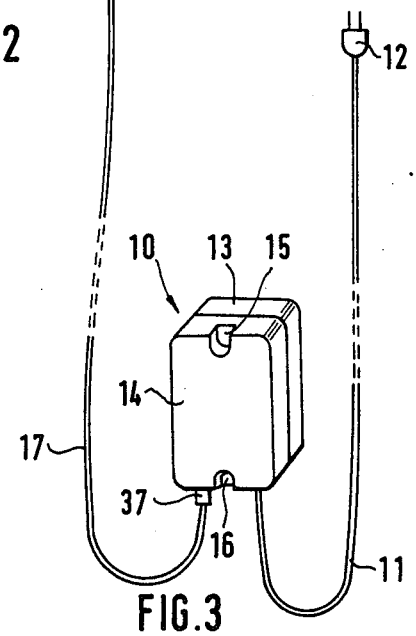

In the accompanying drawings:

FIG. 1 is a schematic representation of the air bubbling massage apparatus, according to the present invention, with respect to a bathtub, FIG. 2 is a perspective view of the exterior of the housing containing the operative elements such as the blower and heater, FIG. 3 is a similar perspective view of the power pack housing.

DESCRIPTION OF THE INVENTION

As FIG. 1 shows, the air bubbling massage apparatus according to the present invention, comprises a porous or holely grid-iron 36 which is adapted to be immersed in a bath 35. This grid-iron 36 is connected by means of an air hose 24 to a water spray generator or gun contained in a first housing 20 which is illustrated as being secured on the bathroom wall adjacent the bathtub so as to be easily manipulated by the bather. The air hose 24 is held, intermediate its ends, by a bracket 34 also on the wall so that it would not interfere with the bather. The housing 20 contains conventional low voltage blower and heater or combination hot air blower and water spray generator. These elements, and freely available and their use in the present combination is believed not to require further description in the present disclosure. However, in accordance with the present invention, the selected components elements, should be either mechanically operable, or operable under low voltage power requirements, not to exceed 24 volts.

The power supply for the component elements contained within the housing 20 is derived over a low voltage connecting cable 17 from a power pack stored in a separate and independent housing 10. The power pack housing is fastened on the bathroom wall, or if desired exterior of the bathroom, in any event out of the area of the bathtub and out of the reach of the bather. Extending into the power pack housing 10 is a line cord 11, having a conventional plug 12 adapted for insertion into a socket receptical 33, through which household, or common line current either a relatively high voltage AC or DC (110 volts or greater) is delivered.

The power pack housing contains at least a transformer capable of stepping-down the relatively high voltage to a low voltage equal to or less than 24 volts. Thus, the current passing over the low voltage cable 17 into the operating elements contained within the housing 20 is of such a level as not to be dangerous at all to the bather. Suitable heater and blower components operable under low voltage alternating current and freely and commerically available. The delivery of current at this level is therefore no problem in forming apparatus capable of the intended function. Heating and blowing elements as well as water-spray generators, operating under low voltage direct current can also be employed. In this instance, the power pack would include in addition to the transformer suitable rectifying and filter condensor means so as to provide smooth direct current from an alternating current line source.

As shown in FIG. 2 the housing 20 is formed of an elongated hollow generally rectangular box 21 open at both ends. The open ends are enclosed by slide plates 22 and 27 which are preferably forced fit therewith so as to be firmly secured in place. Between the housing portions 21, 22 and 27 suitable seal means or similar water and vapor barriers are provided so that the housing, when fully enclosed, is both water and spray proof.

On the upper side of the rectangular box 21 there is formed a pair of openings 22 along slide a central longitudinally extending handle member 31 enabling the housing 20 to be easily transported. The openings 32 can be further be used to provide air openings into the interior of the housing.

One of the side plates, 22, is provided with a connecting member 23 having a tubular socket 35 into which the air hose 24 is received. The low voltage power cable 17 enters the housing 20 through an opening 26. The openings into the housing 20 are sealed in conventional manner.

On the front wall of the housing 20 there is mounted a pair of knobs 28 and 29 which extend into the housing, into operative engagement with adjustable control elements for varying the velocity or speed of the air blower and for controlling the time of operation of the apparatus. Preferably, the timing control is obtained by mechanical means, such as a spring loaded timing relay or timing switch. A lamp 30 is also provided to indicate when the apparatus is in use. The speed of the blower can be regulated by a variable potentiometer, mechanical brake means or in the event a direct current blower is employed by a thyristor diode circuit of conventional nature.

The housing 20 is easily placed on a flat surface such as a table or shelf adjacent the bath, or it can in well known manner, and with the use of suitable fastening means, be secured by its rear wall on the bathroom wall. The rear wall of the housing 20 can be made with cutout key holes for the receipt of suitable brackets or screws, secured to the wall. In this manner it is possible to removably mount the housing 20 in the most convenient place for use.

In FIG. 3, the power pack housing 10 is shown. This housing 10 comprises a box like recepticle formed preferably of two halves 13 and 14 which are securable together to form a hollow container in which the power pack elements can be securely maintained. Suitable seal means, can be placed between or around the contiguous edges of the halves 13 and 14 so as to make this unit itself water and vapor proof. The power pack housing is adapted to be secured more or less permanently to a wall, by arranging suitable screw fastening means through the portions 15 and 16 located allong opposite edges of the outer box half 14. In this manner, the box halves 13 and 14 are simultaneously secured together while mounting the same on the wall. In this manner, the power pack components such as the transformer, rectifier and filter condensors can be securely covered and enclosed and firmly fixed to the wall support.

Preferably, the low voltage cable is connected to the power pack through a separable and removable plug assembly 37 so that the two housings 20 and 10 can be firmly disconnected from each other. This is a particular advantage, since if the housing 20 were to inadvertently fall into the bath, it is possible that the low voltage cord 17 would be disconnected from the power pack thus even separating the housing 20 from the power source, albeit that power source is of the low voltage variety. A similar removable coupling or plug connection such as that shown by 37 can be employed and the connection at 26 of between the low voltage cable and the housing 20, if desired.

Various modifications and changes have been suggested in the foregoing disclosure. Other changes and modifications would be obvious to those skilled in the present art. It is intended therefore that the present disclosure be taken illustrative only of the invention, and not as limiting of its scope.

What we claim is:

1. In hydrotherapy apparatus including a housing within which there is positioned at least a blower means for supplying heated air to said blower and control means for said blower and heated air supply means, a hose communicating at one end thereof with said blower and at the other end thereof with means positionable within a bathtub so as to introduce the heated air thereinto, the improvement comprising in combination a second housing independent of and remote from the blower-containing housing, a step down electrical transformer having an output not greater than 24 volts positioned in said housing and having an input connected to a source of line current, and an elongated low voltage cable connecting the output of said transformer to said blower and heated air supply means and said control means therefor.

2. The apparatus according to claim 1 wherein the housing containing the hot air blower is provided with a handle, and a wall, capable of being stood on a flat surface, and a second wall having means for mounting the same on a supporting wall.

3. The apparatus according to claim 1 including a mechanical means for regulating the time of operation of said hot air blower, having manipulable adjustable means mounted on the exterior of said housing containing such air blower.

4. The apparatus according to claim 3 wherein said mechanical means comprises a spring loaded timer.

5. The apparatus according to claim 1 wherein said power pack includes a rectifier and filter condenser for providing a low voltage direct current and the hot air blowing means is operable by said low voltage direct current.

6. The apparatus according to claim 5 wherein including means for controlling the speed of said hot air blower comprising a thyristor switching circuit.

7. The apparatus according to claim 1 wherein the power pack housing is formed of two portions, the same being securely fastened together to enclose the power pack elements therebetween.

8. The apparatus according to claim 1 wherein said housing containing said hot air blower is provided with seal means to render the same water and vapor proof.

9. The apparatus according to claim 1 including removable coupling means for connecting said low voltage cable and to said power pack housing.

* * * * *